United States Patent [19]

Gonet

[11] Patent Number: 5,068,955

[45] Date of Patent: Dec. 3, 1991

[54] METHOD FOR REPAIRING BROKEN UMBRELLAS

[76] Inventor: Helen F. Gonet, 42 Cliff St., Norwich, Conn. 06460

[21] Appl. No.: 306,570

[22] Filed: Feb. 6, 1989

Related U.S. Application Data

[63] Continuation-in-part of Ser. No. 144,037, Jan. 15, 1988, abandoned.

[51] Int. Cl.[5] ..... A45B 11/00

[52] U.S. Cl. ..... 29/402.09; 135/15.1; 135/33.5

[58] Field of Search ..... 135/36 R, 36 F, 36 RT, 135/33.5; 29/402.01, 402.09

[56] References Cited

U.S. PATENT DOCUMENTS

| | | | |
|---|---|---|---|
| 1,336,218 | 4/1920 | Goldstein | 135/36 RT |
| 1,381,350 | 6/1921 | Seery | 135/36 RT |
| 4,089,416 | 5/1978 | Sims | 135/36 F |
| 4,658,845 | 4/1987 | Okuda | 135/36 RT |

FOREIGN PATENT DOCUMENTS

| | | | |
|---|---|---|---|
| 132323 | 4/1949 | Australia | 135/36 RT |
| 2462263 | 11/1976 | Fed. Rep. of Germany | 135/36 RT |
| 418502 | 12/1910 | France | 135/36 RT |
| 1414055 | 9/1965 | France | 135/36 RT |
| 2543808 | 10/1984 | France | 135/36 RT |

*Primary Examiner*—Henry E. Raduazo
*Attorney, Agent, or Firm*—CTC & Associates

[57] ABSTRACT

An end pin is used for repairing umbrella ribs. The end pin is of one piece construction having a shank and is designed to be easily installed and less prone to breakage than existing designs. This construction provides replacement end pins for repairing umbrellas. The end pins are packaged as a kit and are useful in performing a method of repairing an umbrella including the steps of withdrawing an end pin from a supply of end pins provided by the kit and inserting the shank of the withdrawn end pin through the cover of the umbrella or an attaching loop and into a stem of the umbrella, which stem is in need of repair. The shank passes into interference engagement with the stem into which it is inserted. The end pin has an end tip of larger diameter than the shank and the inserting step is continued until the end tip attains overlapping engagement with the umbrella cover or the attaching loop.

3 Claims, 1 Drawing Sheet

METHOD FOR REPAIRING BROKEN UMBRELLAS

RELATED APPLICATION

This is a continuation-in-part of my co-pending prior application Ser. No. 144,037 filed Jan. 15, 1988, now abandoned.

BACKGROUND OF THE INVENTION

Most umbrellas are constructed with a one piece stem as a superstructure with end pieces either swaged or threaded onto the stem. In other designs, the stem and end fitting is one piece with an integral eyelet and tip for the cloth attachment. The end tips in all of these designs are easily broken and difficult to repair or replace, thus, prematurely ending the useful life of the umbrella. The instant invention provides an improved means and an improved method for addressing these problems.

Typical prior art devices relating to umbrella construction are represented by the following prior U.S. patents which are of interest.

| Patent Number | Date | Inventor |
|---|---|---|
| 4,089,416 | March 22, 1977 | Sims |
| 1,381,350 | June 14, 1921 | Seery |
| 1,336,218 | April 6, 1920 | Goldstein |
| 1,264,076 | April 23, 1918 | Hout |
| 777,999 | December 20, 1904 | Baldwin |
| 297,281 | April 22, 1884 | Meyer |

Sims discloses an umbrella tip repair kit which consists of a plastic tube and conical cap for use when the cover fabric has become loosened from the umbrella stem or rib. This repair kit device is not applicable for the repair of broken threaded end pieces or for original construction and therefore would not satisfy the intended function of the present invention.

Seery discloses a one piece umbrella stem with a rib swaged about the stem. This device was appropriate for original construction utilizing the fabrication techniques of the 1920's. It is not applicable to the hollow stem and threaded end piece construction which the present invention addresses.

Goldstein addresses a method of affixing the cloth cover of an umbrella to a hollow stem or rib by inserting an end pin into the hollow stem or rib and then capturing the cover between said end pin and a hollow tip which fits over said end pin. This device incorporates a two piece construction whereas the present invention accomplishes the same goal with a one piece end pin. In addition, the cover capture by Goldstein is less reliable than the cover-eyelet concept of the present invention.

Hout developed an umbrella attachment loop which consists of clips and twisted pins which form said loop and attach to a U shaped rib. This concept was directed to new construction and is not applicable to modern fabrication techniques for umbrellas.

Baldwin discloses a stem with integral eyelets which were designed to fit into a U shaped rib about the stem and eyelet and is not applicable to a hollow stem or rib as is the present invention.

Meyer also developed a stem and eyelet for a U shaped rib. These concepts do not pemit repair and replacement of the end pin and eyelet and therefore are subject to the problems that the present invention has been developed to address.

Existing umbrella designs fall into two major categories. In one style, the umbrella stems are of one piece construction and include integral eyelets for the cloth attachment. This design also includes an integral end tip. In the second style, the end tip is a separate piece from the stem. The separate end piece contains the cloth attachment location. The end piece is either swaged or threaded onto the stem. In some cases, a rib is placed around the stem or the stem is also referred to as the rib.

In both of these designs, the end tips or the cloth attachment eyelets are easily and often broken. Once this breakage occurs, the stem becomes a potential safety hazard. Repair or replacement of the end tip is very difficult and therefore the useful life of the umbrella is ended. Prior attempts to address end pin breakage have been awkward and generally ineffective.

SUMMARY OF THE INVENTION

The present invention relates to a one piece end pin for umbrella ribs. This end pin concept has been developed to capture the umbrella cover, and to be installed by sliding into the end of a hollow umbrella stem or rib. This one piece end pin has been developed for both new umbrella construction and for the repair of existing threaded designs.

The one piece end pin is inherently stronger than existing designs and therefore enhances umbrella safety and extends umbrella life. The method of installation has been simplified in comparison to existing designs and therefore permits the repair of broken umbrella stem or rib threaded end pins.

The head of the one piece end pins is designed to enhance the safety of the umbrella by eliminating a sharp or narrow end tip which can poke or jab the user. In addition, the head of the one piece end pin can also be utilized for decorative purposes.

DESCRIPTION OF THE INVENTION

Figure 1:
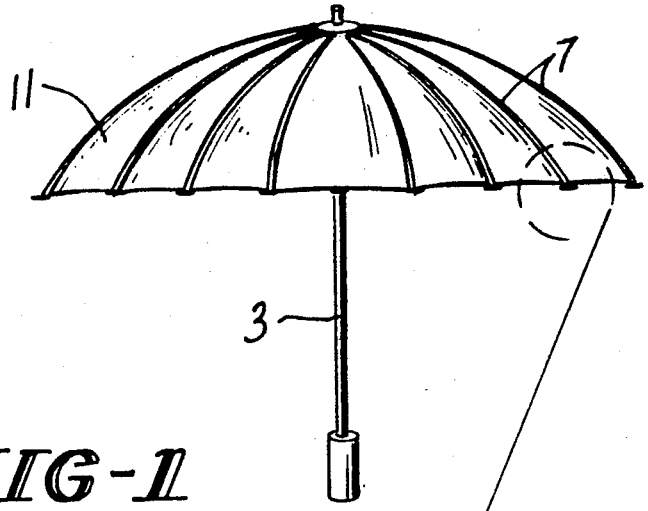
FIG. 1 is a schematic view of a typical umbrella.

Referring to FIG. 1, the pertinent elements of the one piece end pin construction for umbrella ribs are shown. The umbrella 3 is depicted with stems or ribs 7 extending outward when the umbrella is in the open position. The stems or ribs 7 are hollow. The cover 11 is shown spread over the stems or ribs 7. At the end of each stem or rib 7, an end pin 16 is shown.

Figure 2:
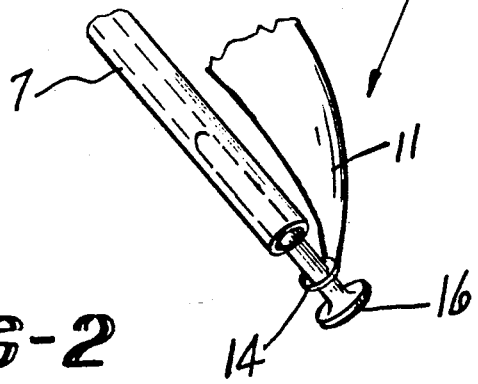
FIG. 2 is a schematic view of a one piece end pin installed in a hollow umbrella stem or rib.
Figure 3:
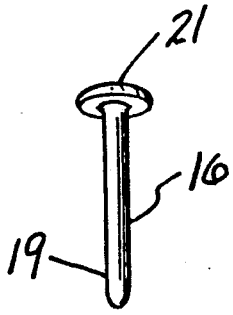
FIG. 3 is a schematic view of the one piece end pin.

The end portion of a typical stem or rib 7 is shown in FIG. 2. The end pin 16 is inserted into the hollow stem or rib 7. The end pin 16 also passes through the cover material attachment loop 14 thus holding the cover 11 in place at the end of each stem or rib 7. It may also be installed by passing through the umbrella cover fabric and into the stem or rib 7. The one piece end pin 16 is depicted in FIG. 3. The one piece end pin consists of a shank 19 and an end tip 21. The shank may be sized in length, thickness, and cross section to match the mating hollow stem or rib. The end tip is sized to capture the cover material attachment loop and to provide a decorative surface. The one piece end pin is sized to provide a slight interference fit with the hollow stem or rib so as to maintain a secure engagement with the stem or rib.

Figure 4:
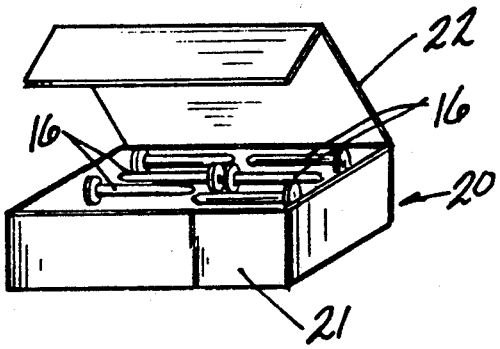
FIG. 4 is a view of a container showing a plurality of the one piece end pins packaged therein.

FIG. 4 is a perspective view of a container shown in the form of a box 20 with a body 21 and a top 22 which is shown open, to reveal that body 21 contains a plurality of end pins 16, which are thus available for use by an umbrella owner for installation in a broken umbrella. End pins 16 are thus packaged in the form of a kit for easy, handy use in repairing umbrella 3 which may be in need of a plurality of end pins 16, either at the same time or at different times.

Thus, the owner of umbrella 3 is provided with a method of repairing umbrella 3 when it is in need of one or more end pins. The method comprises the steps of withdrawing an end pin 16 from a supply of a plurality of end pins 16 and inserting shank 19 of the so withdrawn end pin 16 through cover 11 or attaching loop 14 and into stem or rib 7 which is in need of repair, shank 19 passing into interference engagement with that stem or rib 7. Shank 19 is passed into such interference engagement until end tip 21 attains overlapping engagement with cover 11 or attachment loop 14. The method may be performed by hand.

The invention well attains the stated objects and advantages and others.

The disclosed details are exemplary only and are not to be taken as limitations on the invention except as those details may be included in the appended claims.

What is claimed is:

1. A method of repairing an umbrella with the aid of a kit of solid end pins, each having a smooth shank with an end tip at one end, said method comprising the steps of withdrawing a said end pin from a supply of end pins provided by the kit and inserting the shank of said withdrawn end pin through the cover of the umbrella or an attaching loop and into a hollow rib of the umbrella, which rib is in need of repair, and passing the shank into interference engagement with the rib into which it is being inserted.

2. The method according to claim 1 wherein the passing step is continued until the end tip of the end pin achieves overlapping engagement with the cover or the attaching loop of the umbrella.

3. The method according to claim 1 wherein the withdrawing, inserting and passing steps are performed by hand.

* * * * *